US008026709B2

(12) United States Patent
Huang et al.

(10) Patent No.: US 8,026,709 B2
(45) Date of Patent: Sep. 27, 2011

(54) VOLTAGE GENERATING APPARATUS

(75) Inventors: Hong-Yi Huang, Taipei (TW); Ru-Jie Wang, Taipei County (TW); Yuan-Hua Chu, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 676 days.

(21) Appl. No.: 12/111,210

(22) Filed: Apr. 29, 2008

(65) Prior Publication Data

US 2009/0146625 A1 Jun. 11, 2009

(30) Foreign Application Priority Data

Dec. 5, 2007 (TW) ..... 96146353 A

(51) Int. Cl.
*G05F 3/08* (2006.01)

(52) U.S. Cl. ..... 323/312

(58) Field of Classification Search ..... 323/311, 323/312, 315, 316, 317, 907
See application file for complete search history.

(56) References Cited

U.S. PATENT DOCUMENTS 5,574,392 A * 11/1996 Jordan ..... 327/131
7,619,477 B2 * 11/2009 Segarra ..... 330/289

FOREIGN PATENT DOCUMENTS

| | | |
|---|---|---|
| CN | 101005237 | 7/2007 |
| TW | 577190 | 2/2004 |
| TW | 200506573 | 2/2005 |
| TW | 1281780 | 5/2007 |

OTHER PUBLICATIONS

Giuseppe De Vita et al., "A Sub-1 V, 10 ppm/°C, Nanopower Voltage Reference Generator," IEEE Journal of Solid-State Circuits, 2006, pp. 307-310.
Andrea Boni, "Op-Amps and Startup Circuits for CMOS Bandgap References With Near 1-V Supply," IEEE Journal of Solid-State Circuits, Oct. 2002, vol. 37, No. 10.
G. Giustolisi et al., "A Low-Voltage Low-Power Voltage Reference Based on Subthreshold MOSFETs," IEEE Journal of Solid-State Circuits, Jan. 2003, vol. 38, No. 1.
Ka Nang Leung et al., "A CMOS Voltage Reference Based on Weighted ΔVGS for CMOS Low-Dropout Linear Regulators," IEEE Journal of Solid-State Circuits, Jan. 2003, vol. 38, No. 1.
Ka Nang Leung et al., "A Sub-1-V 15-ppm/°C CMOS Bandgap Voltage Reference Without Requiring Low Threshold Voltage Device," IEEE Journal of Solid-State Circuits, Apr. 2002, vol. 37 No. 4.
"Office Action of Taiwan Counterpart Application", issued on May 24, 2011, p.1-p.4, in which the listed references were cited.

(Continued)

*Primary Examiner* — Adolf Berhane
(74) *Attorney, Agent, or Firm* — Jianq Chyun IP Office

(57) ABSTRACT

A voltage generating apparatus including a voltage generator and a current splitter is provided. The voltage generator has an output node, and generates a first output voltage from the output node. The first output voltage rises when the temperature rises and the current flowing from the output end of the voltage generator is fixed. And the first output voltage drops when the temperature is fixed and the current flowing from the output node of the voltage generator rises. The current splitter is used for increasing the current flowing through the current splitter when the temperature rises. Therefore, the rise of the first output voltage of the voltage generator will be restrained, and the temperature compensation can be achieved.

9 Claims, 11 Drawing Sheets

OTHER PUBLICATIONS

Chorng-Sii Hwang et al. "A High-Precision Time-to-Digital Converter Using a Two-Level Conversion Scheme", IEEE Transactions on Nuclear Science, vol. 51, No. 4, Aug. 2004, 1349~1352.
Poki Chen et al. "A Low Power High Accuracy CMOS Time-To-Digital Converter", 1997 IEEE International Symposium on Circuits and Systems, Jun. 9-12, 1997, Hong Kong, 281~284.
Kari Maatta et al. ''A High-Precision Time-to-Digital Converter for Pulsed Time-of-Flight Laser Radar Applications'', IEEE Transactions on Instrumentation and Measurement, vol. 47, No. 2, Apr. 1998, 521~536.
Kostas Karadamoglou et al. "An 11-bit High-Resolution and Adjustable-Range CMOS Time-to-Digital Converter for Space Science Instruments", IEEE Journal of Solid-State Circuits, vol. 39, No. 1, Jan. 2004, 214~222.
Elvi Raisanen-Ruotsalainen et al. "An Integrated Time-to-Digital Converter with 30-ps. Single-Shot Precision", IEEE Journal of Solid-State Circuits, vol. 35, No. 10, Oct. 2000, 1507~1510.
J.Christiansen et al. "An Integrated CMOS 0.15 ns. Digital Timing Generator for TDC's and Clock Distribution Systems", IEEE 1995, 697~701.
Eric J. Gerds et al. "A CMOS Time to Digital Converter IC with 2 Level Analog CAM", IEEE Journal of Solid-State Circuits, vol. 29, No. 9, Sep. 1994, 1068~1076.
F. Bigongiari et al. "A 250-ps. Time-Resolution CMOS Multihit Time-to-Digital Converter for Nuclear Physics Experiments", IEEE Transactions on Nuclear Science, vol. 46, No. 2, Apr. 1999, 73~77.
Yasuo Arai et al. "A Time Digitizer CMOS Gate-Array with a 250 ps. Time Resolution", IEEE Journal of Solid-State Circuits, vol. 31, No. 2, Feb. 1996, 212~220.
Elvi Raisanen-Ruotsalainen et al. "A Time Digitizer with Interpolation Based on Time-to-Voltage Conversion", IEEE 1997, 197~200.
Y. Arai et al. "TMC-A CMOS Time to Digital Converter Vlsi", IEEE Transactions on Nuclear Science, vol. 36, No. 1, Feb. 1989, 528~531.
M. S. Gorbics et al. "A High Resolution Multihit Time to Digital Converter Integrated Circuit", IEEE Transactions on Nuclear Science, vol. 44, No. 3, Jun. 1997, 379~384.
Piotr Dudek et al. "A High-Resolution CMOS Time-to-Digital Converter Utilizing a Vernier Delay Line", IEEE Transactions on Solid-State Circuits, vol. 35, No. 2, Feb. 2000, 240~247.
Chorng-Sii Hwang et al. "A High-Precision Time-to-Digital Converter Using a Two-Level Conversion Scheme", IEEE Transactions on Nuclear Science, vol. 51, No. 4, Aug. 2004,1349~1352.
Chorng-Sii Hwang et al. "A High-Resolution and Fast-Conversion Time-to-Digital Converter", IEEE 2003, I-37~I-40.
Poki Chen et al. "A Low Power High Accuracy CMOS Time-to-Digital Converter", 1997 IEEE International Symposium on Circuits and Systems, Jun. 9-12,1997, Hong Kong, 281~284.
Poki Chen et al. "A Cyclic CMOS Time-to-Digital Converter With Deep Sub-nanosecond Resolution", IEEE 1999 Custom Integrated Circuits Conference, 605~608.
C. Thomas Gray et al. "A Sampling Technique and Its CMOS Implementation with 1 Gb/s Bandwidth and 25 ps Resolution", IEEE Journal of Solid-State Circuits, vol. 29, No. 3, Mar. 1994, 340~349.
Uming Ko et al. "High Performance, Energy Efficient Master-Slave Flip-Flop Circuits", 1995 IEEE, 16~17.
Hong-Yi Huang et al. "A New Cycle-Time-to-Digital Converter With Two Level Conversion Scheme", 2007 IEEE, 2160~2163.

* cited by examiner

VOLTAGE GENERATING APPARATUS

CROSS-REFERENCE TO RELATED APPLICATION

This application claims the priority benefit of Taiwan application serial no. 96146353, filed on Dec. 5, 2007. The entirety the above-mentioned patent application is hereby incorporated by reference herein and made a part of specification.

BACKGROUND OF THE INVENTION

1. Field of the Invention

The present invention generally relates to a voltage generating apparatus.

2. Description of Related Art

With the popularization of electronic products, the electronic products are promoted all over the world. It is the most basic requirement that the same kind of electronic products should be able to work in completely different environments. For example, the same type of mobile phone may be sold to high-latitude countries with cold weather, or sold to countries on the hot equator. Further, due to the mobility of the user, the same mobile phone must work in different environments. To meet the above practical demands, it is a critical issue for designers to provide a circuit adaptable to changes of the environment.

In all the electronic systems, some analog circuits are indispensable. These analog circuits generally require an accurate reference power supply to remain stable. Thus, many so-called band gap voltage generating apparatus are put forward. The most important achievement of the voltage generating apparatus is the self-compensation capability of the output voltage confronted with a changing temperature. FIG. 1 shows a conventional voltage generating apparatus with temperature compensation capability. In this conventional voltage generating apparatus, two bipolar junction transistors (BJTs) Q1, Q2 are adopted, in which the current on a collector of each BJT rises when the temperature is increasing (i.e., a positive temperature coefficient (PTC)), so as to compensate the drop of the span-voltage between an emitter and a base of each BJT due to the increase of the temperature (i.e., a negative temperature coefficient (NTC)), thereby maintaining an output voltage VREF.

However, besides to output an accurate and stable voltage, the power consumption of the circuit should also be considered. In the conventional apparatus shown in FIG. 1, due to a restrained input voltage, an operational amplifier U1 needs a high system voltage to work normally, and thus the voltage generating apparatus has to consume a large amount of power. Therefore, to resolve this, the architecture of another conventional voltage generating apparatus is proposed, as shown in FIG. 2. In the conventional voltage generating apparatus of FIG. 2, a resistor string is employed to divide the input voltage of the operational amplifier U1 in FIG. 1, and then the voltage is input into the operational amplifier U1 accompanied with a new input circuit of the operational amplifier U1 (the input circuit is only constituted by metal oxide semiconductor field effect transistors (MOSFETs)), so as to lower the working voltage of the operational amplifier U1, thereby decrease the power consumption. Moreover, as a new output stage circuit is added, such a conventional voltage generating apparatus may output an output voltage VREF lower than 1 V.

FIGS. 3 and 4 show the architecture of another conventional voltage generating apparatus. Different from the above conventional voltage generating apparatus, the voltage generating apparatus in FIGS. 3 and 4 are constituted by complementary metal oxide semiconductor field effect transistors (CMOSFETs). This conventional circuit architecture has the advantages that the adopted CMOSFETs are cheaper, and it is easy to output an output voltage VREF lower than 1 V compared with the above circuit with BJTs architecture using the CMOSFETs.

SUMMARY OF THE INVENTION

Accordingly, the present invention is directed to a voltage generating apparatus for generating a first output voltage. The first output voltage rises when the temperature increases within a certain range, and drops when the temperature exceeds this range, and thereby achieves the purpose of the temperature compensation.

A voltage generating apparatus including a voltage generator and a current splitter is provided. The voltage generator has an output end, and generates a first output voltage from the output end. The first output voltage rises when the temperature increases and the current flowing from the output end of the voltage generator is fixed. The first output voltage drops when the temperature is fixed and the current flowing from the output end of the voltage generator increases. In addition, the current splitter is coupled to the output end of the voltage generator for increasing the current flowing through the current splitter when the temperature increases.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
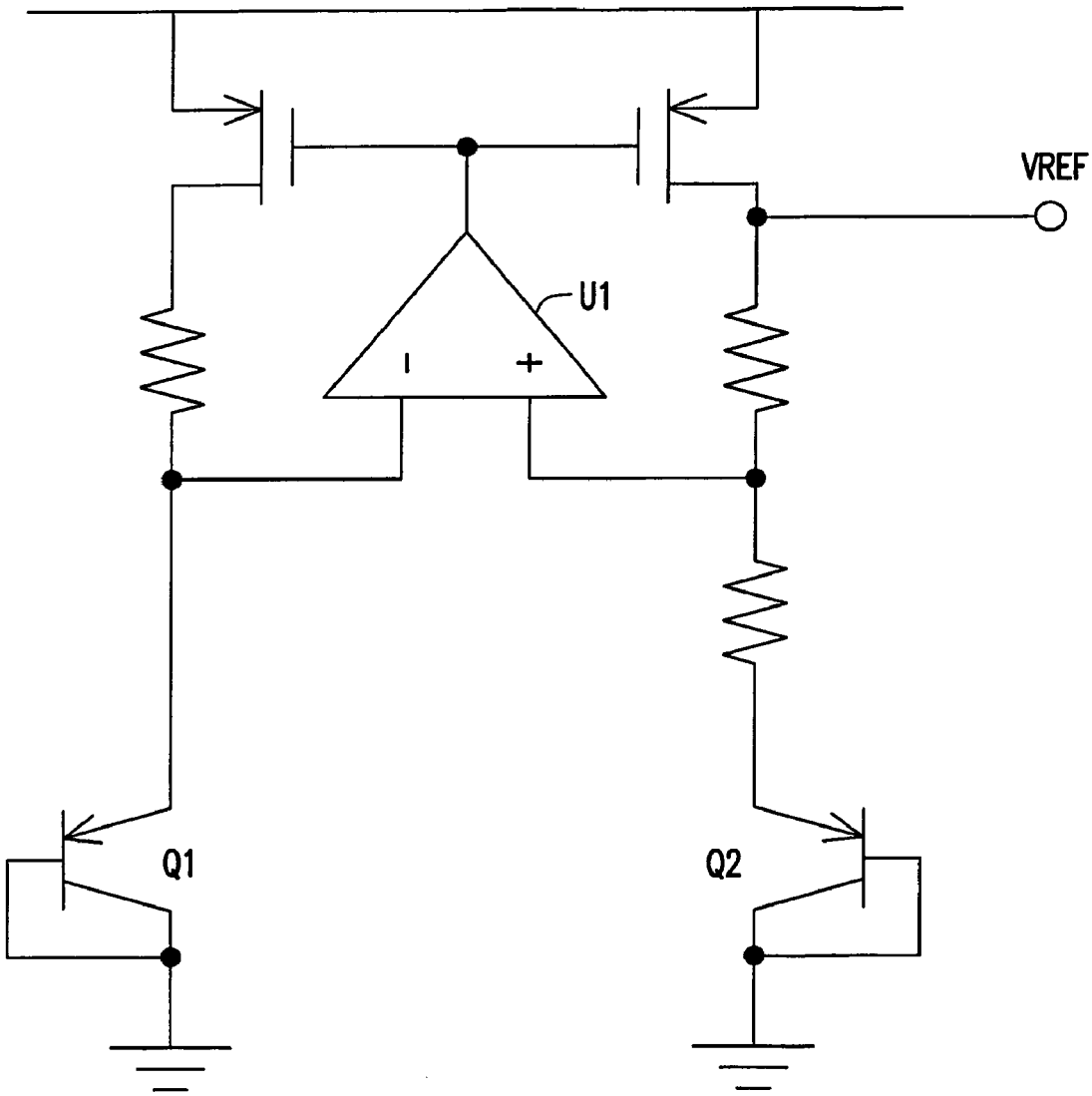
FIG. 1 (PRIOR ART)
FIGS. 1-4 are schematic views of a conventional voltage generating apparatus.
Figure 2:
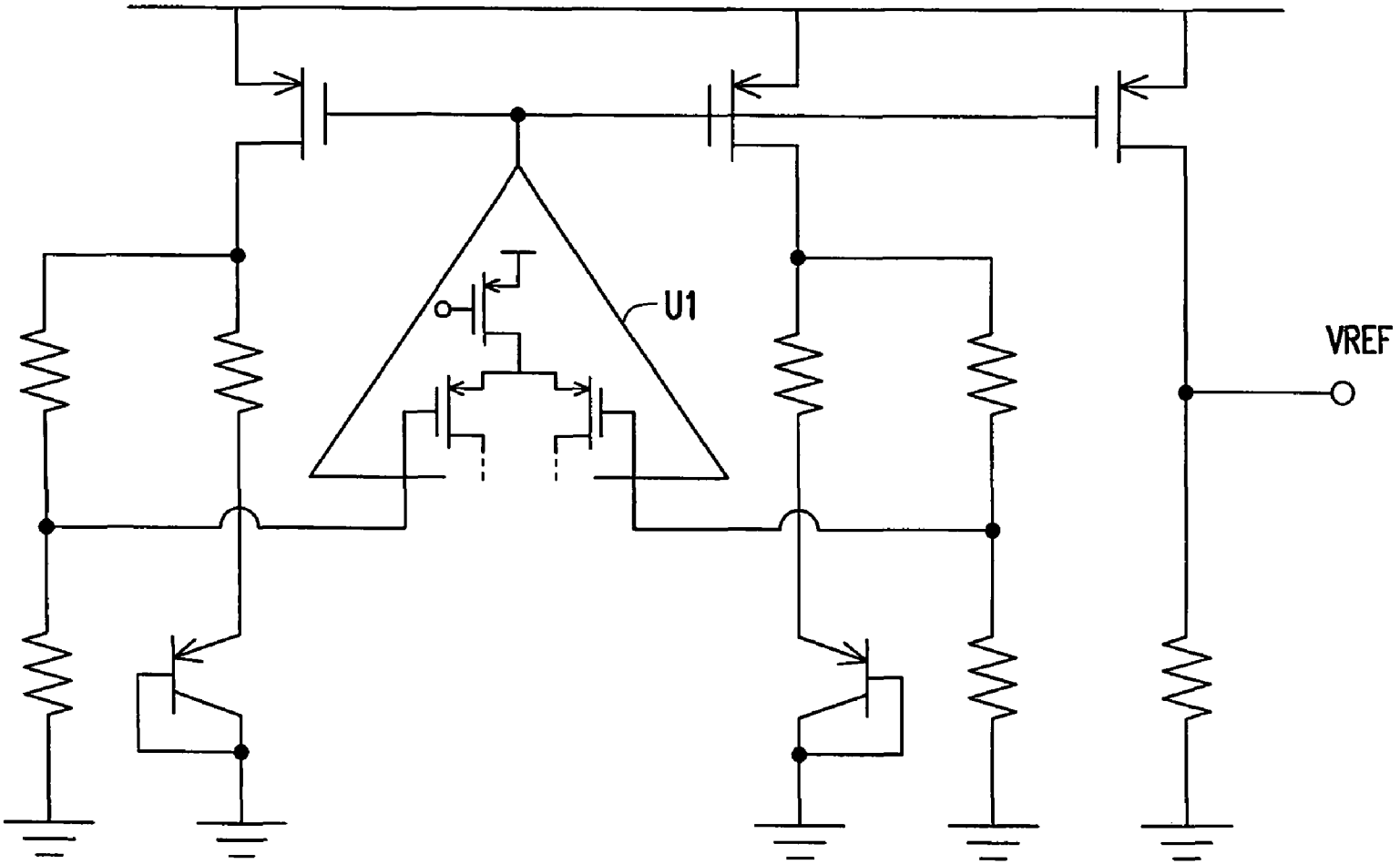
FIG. 2 (PRIOR ART)
Figure 3:
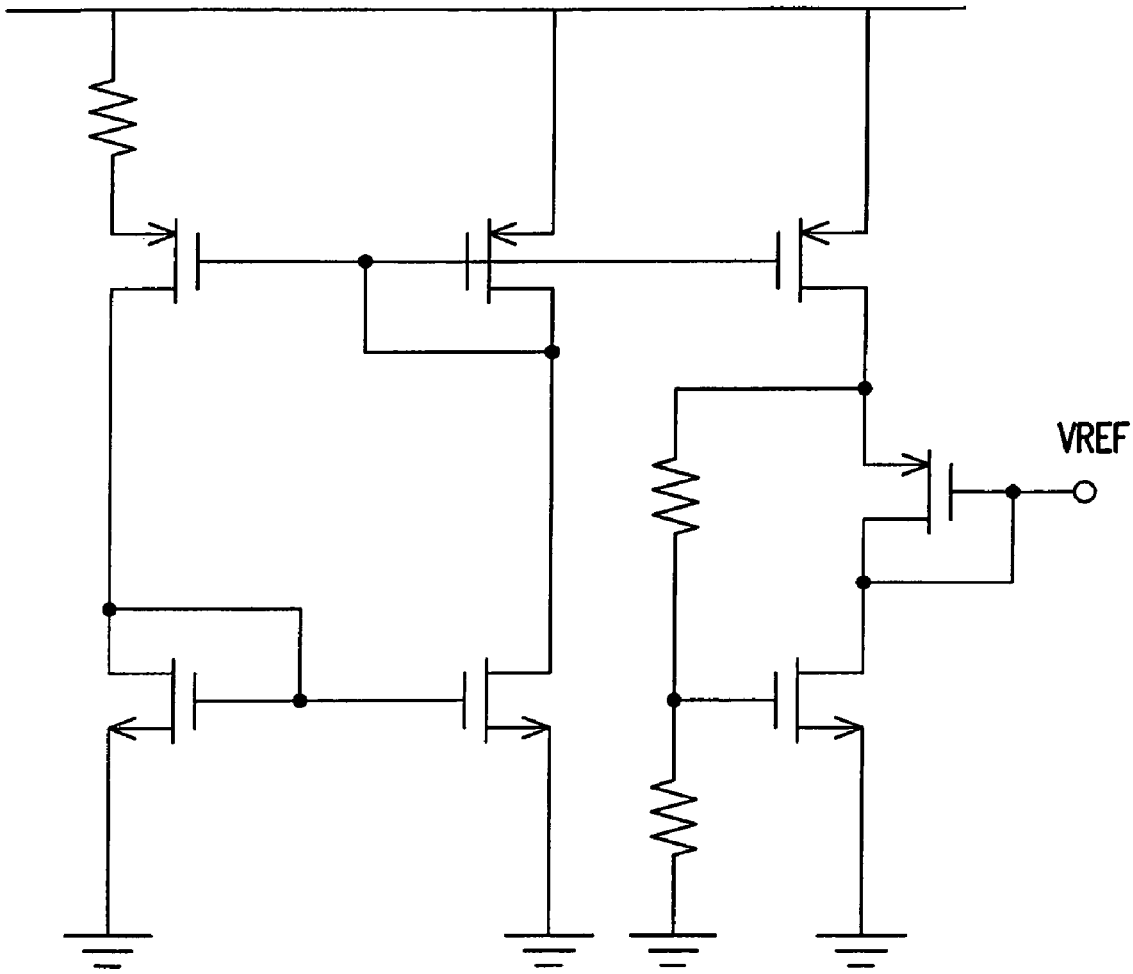
FIG. 3 (PRIOR ART)
Figure 4:
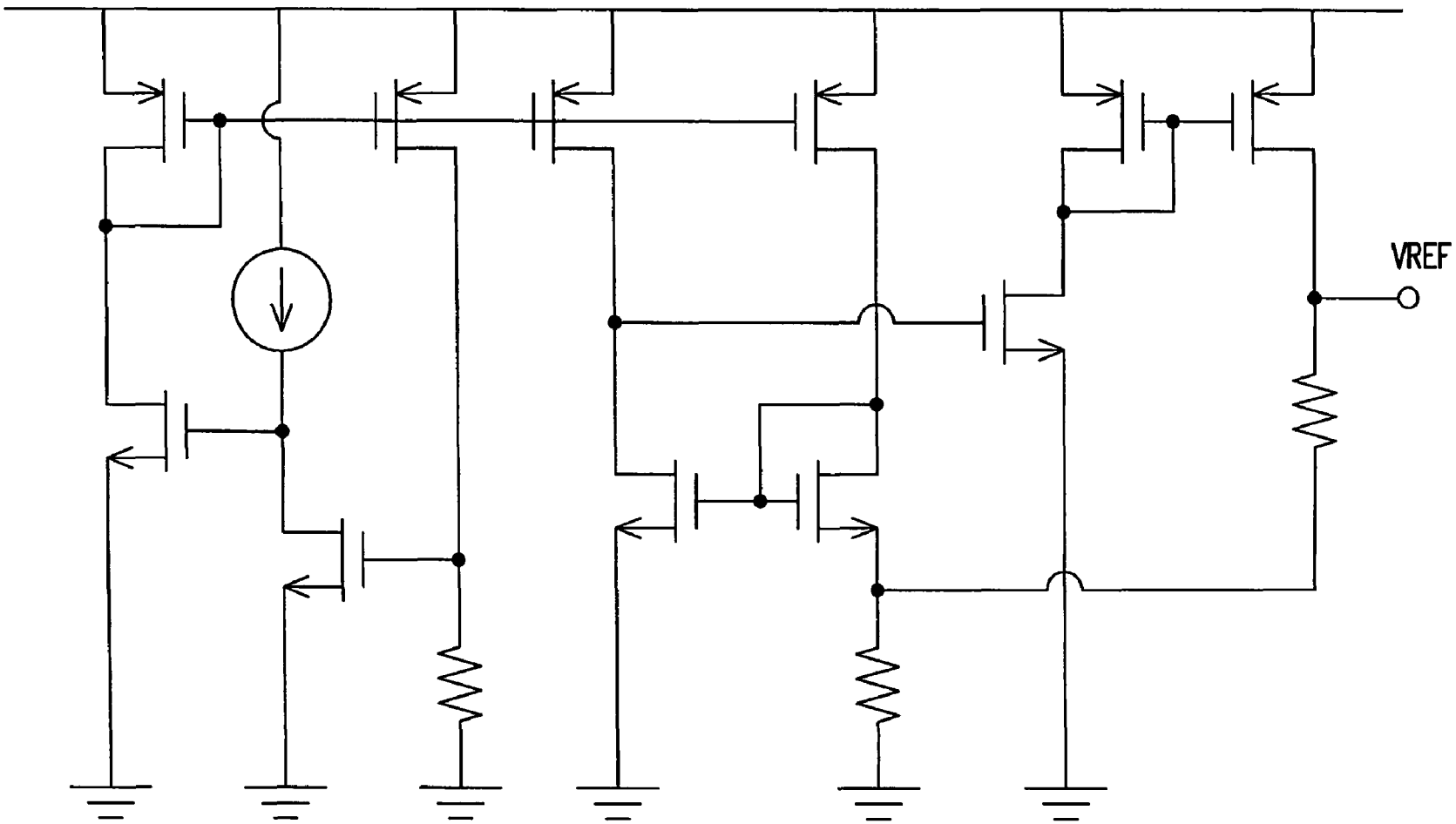
FIG. 4 (PRIOR ART)

Reference will now be made in detail to the present embodiments of the invention, examples of which are illustrated in the accompanying drawings. Wherever possible, the same reference numbers are used in the drawings and the description to refer to the same or like parts.

The present invention provides a structure of a voltage generating apparatus capable achieving a better temperature compensation effect and reducing the power consumption. Technical characteristics of the present invention will be illustrated in detail below.

Figure 5A:
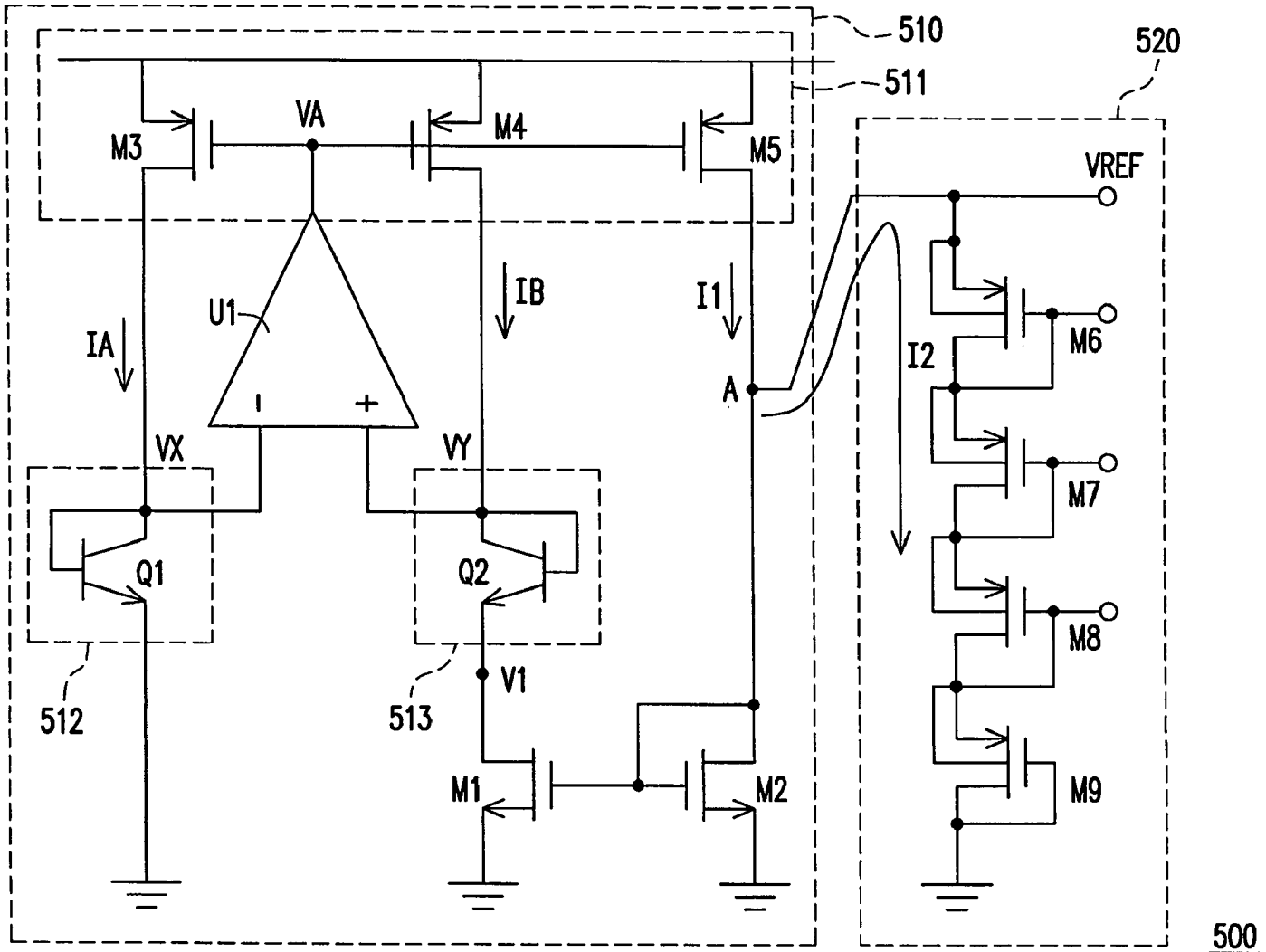
FIG. 5A is a schematic view of a voltage generating apparatus 500 according to an embodiment of the present invention.

First, referring to FIG. 5A, a schematic view of a voltage generating apparatus 500 according to an embodiment of the present invention is shown. The voltage generating apparatus 500 includes a voltage generator 510 and a current splitter 520.

The voltage generator 510 has an output node A, and is used for generating a first output voltage VREF from the output node A. The voltage generator 510 has two electrical characteristics, wherein the first one includes the first output voltage VREF rises with the increasing temperature when the current splitter 520 shown in FIG. 5A has not been used, and the second electrical characteristic of the voltage generator 510 includes the first output voltage VREF decrease when the temperature is fixed and a current I2 is split from the output node A of the voltage generator 510.

Figure 5B:
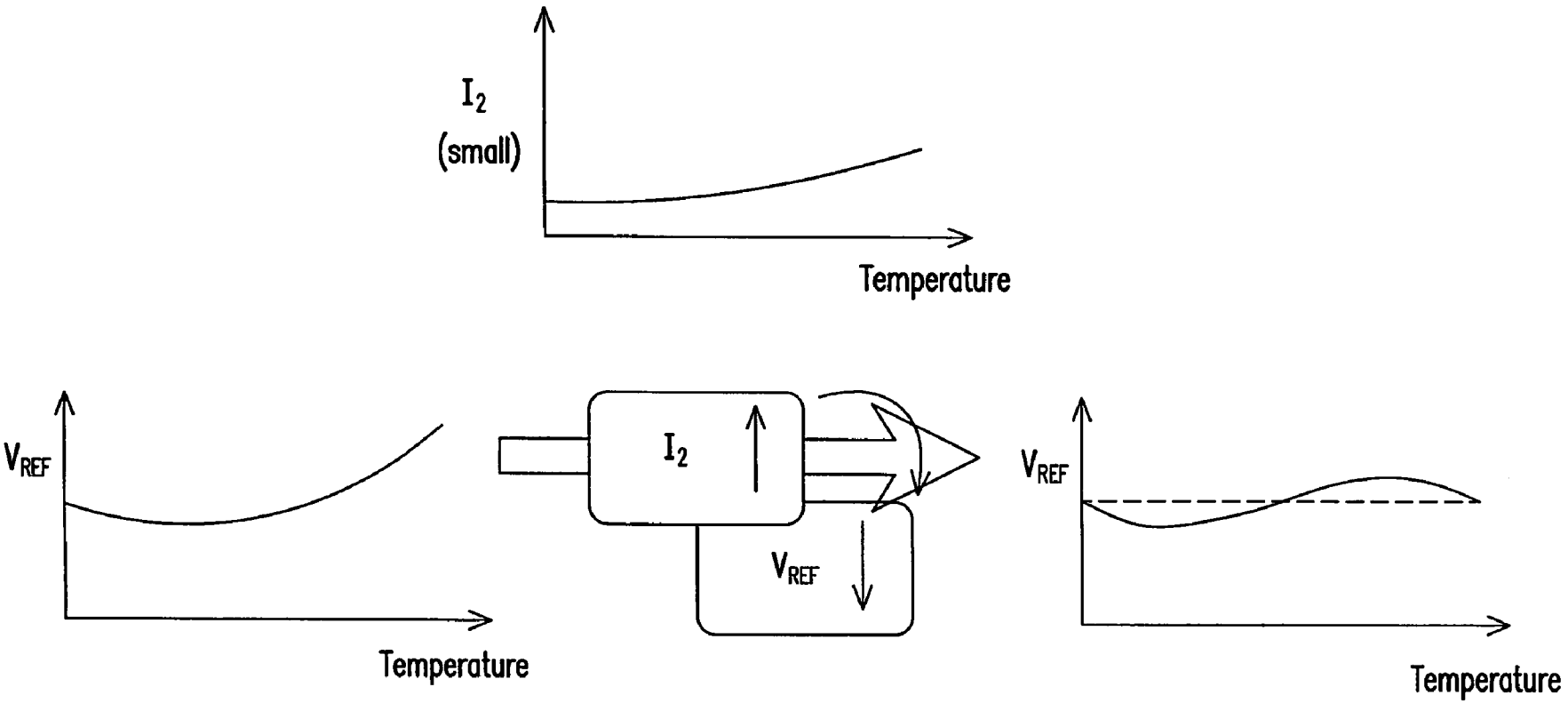
FIG. 5B is a schematic view showing the temperature compensation of the first output voltage VREF.

According to the above characteristics of the voltage generator 510, a current splitter 520 is coupled to the output node A of the voltage generator 510. The current splitter 520 is characterized in that the current I2 flowing through the current splitter 520 rises when the temperature rises. Therefore, by combining the characteristics of the voltage generator 510 and the current splitter 520 together, when the temperature rises, the split current I2 added by the current splitter 520 in the voltage generating apparatus 500 may be used to restrain the first output voltage VREF generated by the voltage generator 510 originally rising with the increasing temperature, so as to achieve the temperature compensation by the voltage generating apparatus 500. The above illustration is reflected in FIG. 5B (a schematic view showing the temperature compensation of the first output voltage VREF).

In the above paragraph, the operating principle of an embodiment of the voltage generating apparatus 500 with temperature compensation capability in FIG. 5A is briefly introduced. To make those of ordinary skill in the art understand the implementation of the present invention more clearly, details of the present invention will be further illustrated below.

Still referring to FIG. 5A, the voltage generator 510 includes a current source 511, an operational amplifier U1, a first voltage source 512, a second voltage source 513, a transistor M1, and a transistor M2.

The current source 511 generates a first current IA, a second current IB, and a third current I1 according to a control voltage VA. A ratio between the first current IA, the second current IB, and the third current I1 is 1:1:G, in which G is a rational number. The first current IA is provided to a first end of the first voltage source 512, and serves as a bias current. Similarly, the second current IB is provided to a first end of the second voltage source 513, and serves as a bias current.

In this embodiment, the current source 511 includes a transistor M3, a transistor M4, and a transistor M5. The transistor M3 comprises a gate, a first drain/source, and a second drain/source, in which the first drain/source is coupled to a system voltage, the gate receives the control voltage VA, and the second drain/source is used for transmitting the first current IA. Likewise, the transistor M4 comprises a gate, a first drain/source, and a second drain/source, in which the first drain/source is coupled to the system voltage, the gate is coupled to the gate of the first transistor and receives the control voltage VA, and the second drain/source is used for transmitting the second current IB. The transistor M5 also comprises a gate, a first drain/source, and a second drain/source, in which the first drain/source is coupled to the system voltage, the gate is coupled to the gate of the first transistor and receives the control voltage VA, and the second drain/source is used for transmitting the third current I1. To make the ratio between the first current IA, the second current IB, and the third current I1 as 1:1:G, a ratio between channel sizes of the transistors M3, M4, and M5 is 1:1:G. In addition, the value of G may be adjusted by adjusting the size of the transistor M5.

Further, the first voltage source 512 comprises a first end and a second end, in which the first end is coupled to the current source 511, and the second end is coupled to a ground voltage. The second voltage source 513 comprises a first end and a second end, in which the first end is coupled to the current source 511. The operational amplifier U1 comprises a first input end, a second input end, and an output end, in which the first input end is coupled to the first end of the first voltage source 512, the second input end is coupled to the first end of the second voltage source 513, and the output end outputs the control voltage VA. Moreover, the coupling situation of the transistors M1 and M2 is respectively described as follows. The transistor M1 has a gate, a first drain/source, and a second drain/source, in which the second drain/source is coupled to the ground voltage, and the first drain/source is coupled to the second end of the second voltage source 513. The transistor M2 comprises a gate, a first drain/source, and a second drain/source, in which the second drain/source is coupled to the ground voltage, and the first drain/source, the gate, the gate of the transistor M1, the place where the current source 511 outputs the third current I1, and the output node A of the voltage generator 510 are all coupled together.

In this embodiment, the first voltage source 512 and the second voltage source 513 respectively include a transistor Q1 and a transistor Q2. The two transistors are both BJTs. The transistor Q1 comprises an emitter coupled to the ground voltage, and a base and a collector coupled to the first end of the first voltage source 512. The transistor Q2 comprises an emitter coupled to the first drain/source of the transistor M1, and a base and a collector coupled to the first end of the second voltage source 513.

During the operation of the operational amplifier U1, a voltage VX at the first end of the first voltage source 512 is equal to a voltage VY at the first end of the second voltage source 513. The first voltage generated by the first voltage source 512 is equal to the voltage VX at the first end of the first voltage source 512 as the second end thereof is grounded. A voltage difference of the second voltage generated by the second voltage source 513 is equal to the result of subtracting a voltage V1 from the voltage VY at the first end of the second voltage source 513, in which the voltage V1 is a voltage at the second end of the second voltage source 513. As the first voltage generated by the first voltage source 512 and the second voltage generated by the second voltage source 513 both have an NTC, and the NTC of the first voltage generated by the first voltage source 512 is larger than that of the second voltage generated by the second voltage source 513 (i.e., the NTC of the first voltage generated by the first voltage source 512 has an absolute value lower than that of the NTC of the second voltage generated by the second voltage source 513), the voltage V1 has a PTC.

Still referring to FIG. 5A, the transistor M1 works in a linear region under the control of a feedback loop formed by the transistor M2. The current flowing through the transistor M1 may be expressed by Formula (1):

$$I_B = \mu_n \cdot C_{ox} \cdot \left(\frac{W}{L}\right)_1 \cdot \left[(V_{GS1} - V_{thn}) \cdot V1 - \frac{1}{2} \cdot V1^2\right] \tag{1}$$

in which $\mu_n$ is an electron mobility, $C_{ox}$ is the gate capacitance per unit area, and $(W/L)_1$ is a ratio between the channel width and channel length of the transistor M1, $V_{GS1}$ is a voltage different between the gate and the source of the transistor M1, and $V_{thn}$ is a threshold voltage of an NMOSFET (the transistor M1 of this embodiment is an NMOSFET). In addition, V1 is equal to $V_T \ln(N)$, and $V_T$ is a thermal voltage.

It can be clearly seen from Formula (1) that, as the voltage V1 is characterized in having a PTC, the second current IB is also characterized in having a PTC. Further, the transistor M2 works in a saturation region, and the third current I1 provided by the current source 511 and flowing through the transistor M2 is G times larger than the second current IB flowing through the transistor M1. The above relations may be expressed in Formula (2) as follows:

$$I_1 = G \cdot I_B = \frac{1}{2} \cdot \mu_n \cdot C_{ox} \cdot \left(\frac{W}{L}\right)_2 \cdot (V_{GS2} - V_{thn})^2 \tag{2}$$

in which $V_{GS2}$ is a differential voltage between the gate and the source of the transistor M2, and $(W/L)_2$ is a ratio between the channel width and channel length of the transistor M2.

Next, divide Formula (1) by Formula (2). Further, as the differential voltage $V_{GS1}$ between the gate and the source of the transistor M1 is equal to the differential voltage $V_{GS2}$ between the gate and the source of the transistor M2, and the differential voltage $V_{GS2}$ between the gate and the source of the transistor M2 is equal to the output voltage VREF, Formula (3) is obtained as follows:

$$2 \cdot K \cdot G = \frac{Z^2}{\left(Z \cdot V1 - \frac{1}{2} \cdot V1^2\right)} \tag{3}$$

in which $K=[(W/L)_1/(W/L)_2]$, and $Z=(VREF-V_{thn})$. It should be noted that, the transistor M1 must remain working on linear region and the transistor M2 must remain working on saturation region, so the product of K and G should be larger than 1.

Accordingly, Z in Formula (3) is extracted to get two square roots shown in Formulas (4) and (5):

$$Z=[K \cdot G+\sqrt{K \cdot G \cdot (K \cdot G-1)}] \cdot V1 \tag{4}$$

$$Z=[K \cdot G-\sqrt{K \cdot G \cdot (K \cdot G-1)}] \cdot V1 \tag{5}$$

As the product of K and G should be larger than 1, it can be deduced that the value of Z in Formula (5) is lower than V1. However, as the transistor M1 works in the linear region, the value of Z cannot be lower than V1. Thus, the value of Z obtained from Formula (5) is not desired, and the value of Z obtained from Formula (4) is demanded by this embodiment.

Further, it can be deduced from Formula (4) that the value of the voltage VREF may be expressed by Formula (6):

$$V_{REF}=[K \cdot G+\sqrt{K \cdot G \cdot (K \cdot G-1)}] \cdot V1+V_{thn} \tag{6}$$

As can be seen from Formula (6), an appropriate product of K and G may be selected to obtain a desired output voltage VREF.

The current splitter 520 is a voltage divider for generating a current I2, and the current I2 has a PTC. In order to generate a temperature coefficient current, the current splitter 520 includes serially coupled transistors M6-M9. Each of the transistors M6-M9 has a gate, a first drain/source, a second drain/source, and a base, in which the base is coupled to the first drain/source, and the gate is coupled to the second drain/source. More importantly, the transistors M6-M9 all work in a sub-threshold region, as transistors working in the sub-threshold region are characterized in increasing the current flowing through when the temperature is increasing, and the current will rise more significantly at a higher temperature. Incidentally, the current splitter 520 with the architecture of a voltage divider may serve as a voltage divider, such that the first output voltage VREF may be divided into any equal parts. In this embodiment, as the current splitter 520 adopts four transistors, three groups of voltages such as a quarter of, a half of, three quarters of the first output voltage VREF may be generated to provide a broader application range.

In view of the above, the first output voltage VREF generated by the voltage generator 510 in the voltage generating apparatus 500 is characterized in rising with the increasing temperature. Moreover, the current splitter 520 generates the split current I2 for restraining the first output voltage VREF when the temperature is high enough, so as to achieve an effective temperature compensation effect of the first output voltage VREF of the voltage generating apparatus 500, thereby expanding the applicable temperature range.

Figure 6:
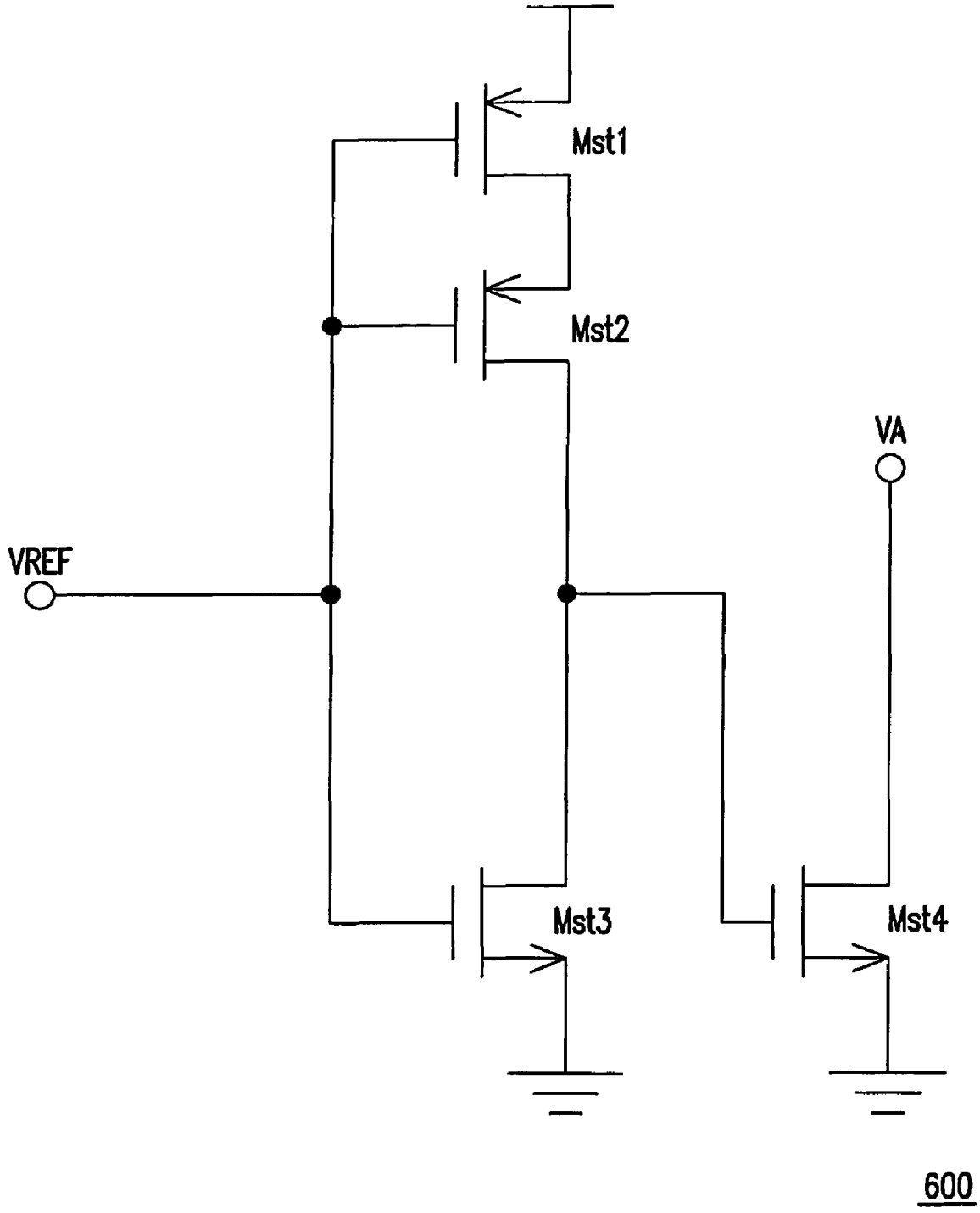
FIG. 6 is a schematic view of a start-up circuit 600.

FIG. 6 is a schematic view of a start-up circuit 600. Referring to FIG. 6, the voltage generating apparatus 500 further includes the start-up circuit 600. The start-up circuit 600 comprises an input node and a feedback node, in which the feedback node is coupled to the output node VA of the operational amplifier U1, and the input node is coupled to the output node A of the voltage generator 510, for stabilizing the first output voltage VREF at the moment the system voltage is started.

In this embodiment, the start-up circuit 600 includes a transistor Mst1, a transistor Mst2, a transistor Mst3, and a transistor Mst4. The transistor Mst1 comprises a gate coupled to the input node VREF of the start-up circuit 600, and a first drain/source coupled to the system voltage. The transistor Mst2 comprises a gate, a first drain/source, and a second drain/source, in which the gate is coupled to the input end VREF of the start-up circuit 600, and the first drain/source is coupled to a second drain/source of the transistor Mst1. The transistor Mst3 comprises a gate, a first drain/source, and a second drain/source, in which the gate is coupled to the input node VREF of the start-up circuit 600, the first drain/source is coupled to the second drain/source of the second transistor Mst2, and the second drain/source is coupled to the ground voltage. The fourth transistor Mst4 comprises a gate, a first drain/source, and a second drain/source, in which the gate is coupled to the second drain/source of the second transistor Mst2, the second drain/source is coupled to the ground voltage, and the first drain/source is coupled to the feedback end VA of the start-up circuit 600.

Figure 7:
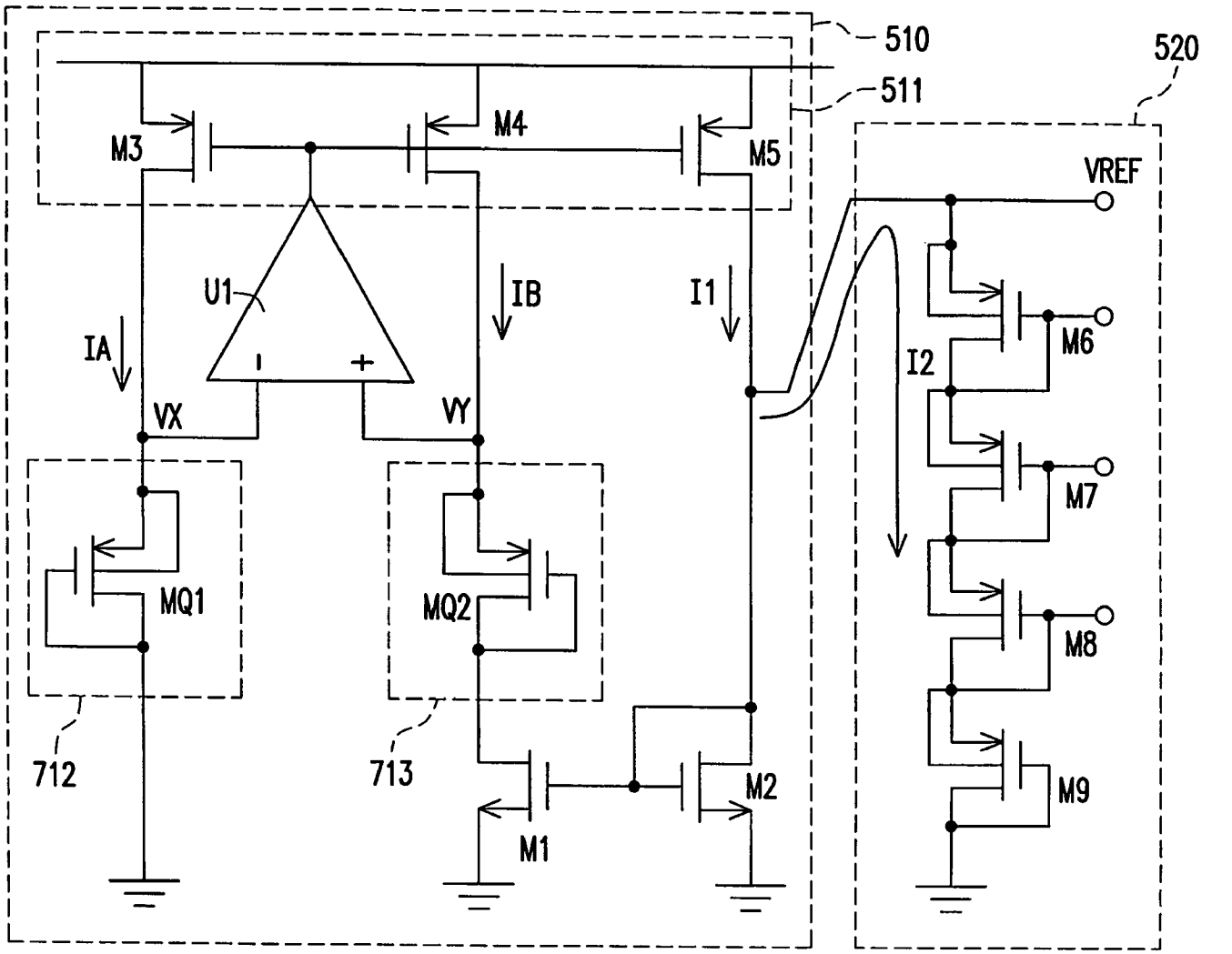
FIG. 7 shows a voltage generating apparatus 700 according to another embodiment of the present invention.

Referring to FIG. 7, a voltage generating apparatus 700 according to another embodiment of the present invention is shown. Different from the voltage generating apparatus 500 in FIG. 5A, in this embodiment, MOSFETs MQ1, MQ2 are respectively adopted by the first voltage source 712 and the second voltage source 713, instead of the transistors Q1, Q2 employed by the first voltage source 512 and the second voltage source 513 in the embodiment of FIG. 5A. However, the operating principle of the voltage generating apparatus 700 are similar to those of the voltage generating apparatus 500, and the principle of the temperature compensation of the output voltage VREF is also the same, so the detailed description thereof omitted hereby.

Figure 8:
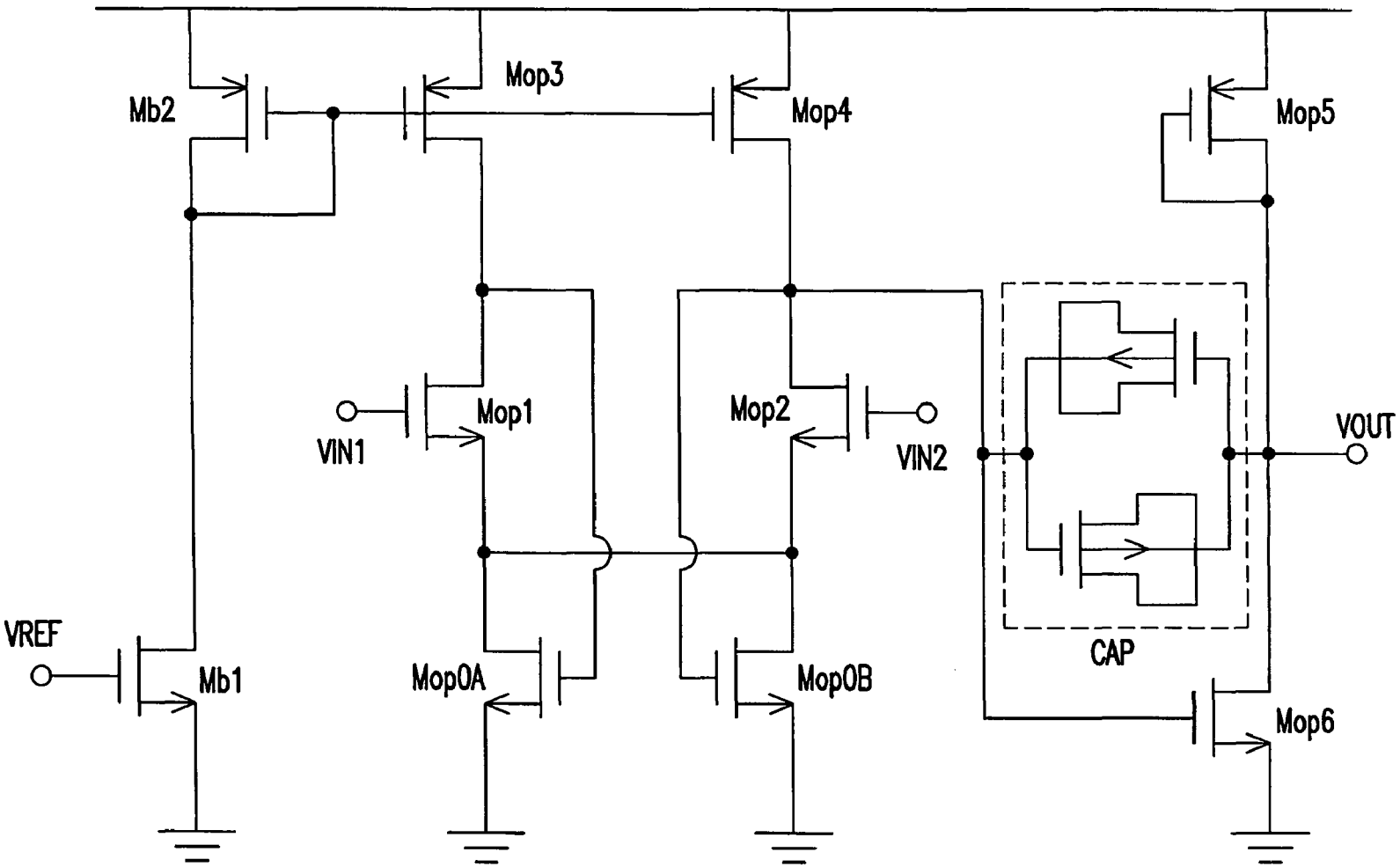
FIG. 8 shows an embodiment of the amplifier U1 in the voltage generating apparatus 500 according to the present invention.

FIG. 8 shows an embodiment of the operational amplifier U1 in the voltage generating apparatus 500 according to the present invention. The operational amplifier U1 in FIG. 8 is referred to in "Op-amps and startup circuit for CMOS bandgap references with near 1-V supply" issued in *Solid State Circuit*, on Pages 1339-1343, Volume 37, published by Institute of Electrical and Electronic Engineers (IEEE) in October 2002. The operational amplifier U1 is used for lowering the line sensitivity of the voltage generating apparatus. In addition, the operational amplifier U1 consumes low power, and capacitors C1 and C2 made of passive devices are now implemented by transistor capacitors, so as to avoid undesirable temperature compensation due to the adoption of passive devices, and effectively reduce the power consumption of the voltage generating apparatus 500.

Figure 9:
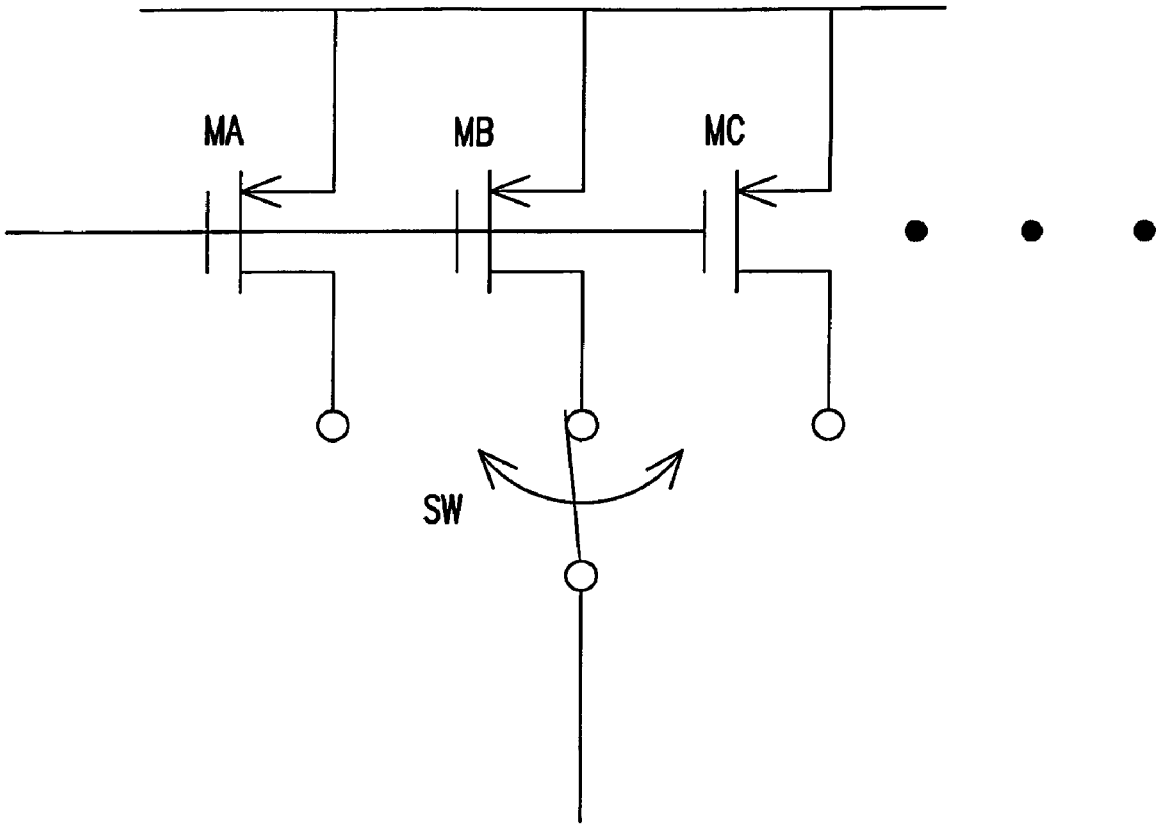
FIG. 9 shows an embodiment of adjusting the channel size of the transistor M5 in the voltage generating apparatus 500.

Referring to FIG. 9, an embodiment of adjusting the channel size of the transistor M5 in the voltage generating apparatus 500 is shown. Transistors MA, MB, and MC with different channel sizes and a selector SW are shown in the figure. A greater value of G is obtained by choosing the transistor M5 with a larger channel size. Further, seen from Formula (5), different values of G contribute to different output voltages VREF. Therefore, a transistor M5 with a selective channel size is fabricated to enable the voltage generating apparatus 500 to flexibly and timely adjust the output voltage VREF, so as to meet more requirements.

Figure 10:
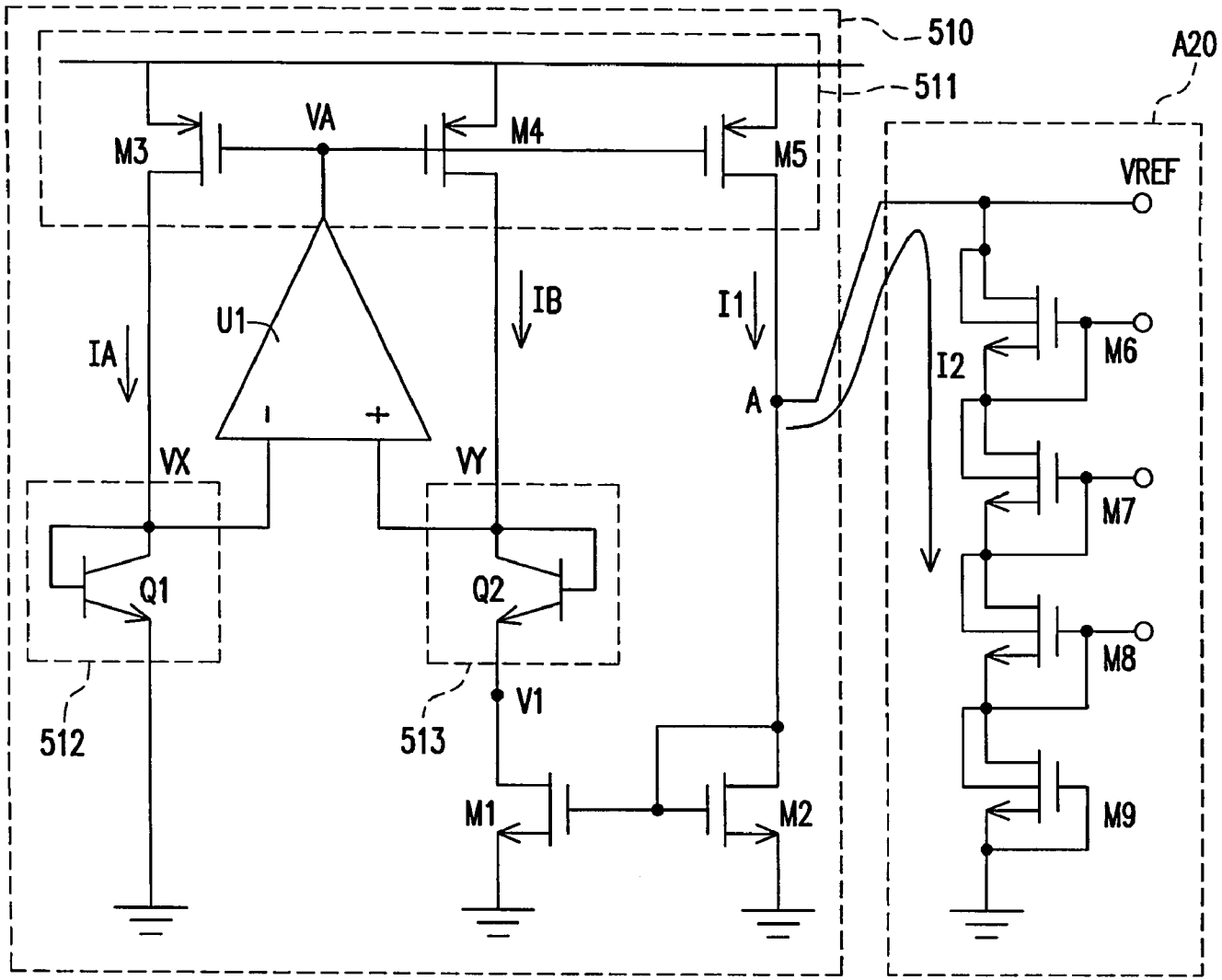
FIG. 10 shows another embodiment of a voltage generating apparatus.

Further, referring to FIG. 10, another embodiment of a voltage generating apparatus is shown. In FIG. 10, different from the voltage generating apparatus 500 in the above embodiment, this embodiment further has a current splitter A20, in which the transistors M6-M9 adopted by the current splitter A20 are NMOSFETs. During the process, if NMOSFETs are turned on slowly/fast and PMOSFETs are turned on fast/slowly, the current splitter constituted by NMOSFETs may work more effectively. Moreover, to eliminate body-effect, the bases of the transistors M6-M9 in the current splitter A20 are coupled together. Thus, a deep N-well of a large area is constructed. Therefore, a P-well is isolated. Further, the transistor M5 may also be a single PMOSFET, instead of a plurality of PMOSFETs connected in parallel. In addition, the current splitter A20 constituted by NMOSFETs is also characterized in process drift the same as that of the transistors M1 and M2.

In view of the above, the present invention provides a voltage generating apparatus, in which a voltage divider capable of generating a large current within a high temperature range is used to expand the working temperature range of the voltage generating apparatus. Besides, elements such as resistors with a large area but having an undesirable temperature coefficient are not adopted so as to stabilize the voltage output, and reduce the area of the circuit, thereby cutting down the cost.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A voltage generating apparatus, comprising:

a voltage generator, comprising an output node, for generating a first output voltage from the output end, wherein the first output voltage rises in response to a rising temperature and a current flowing from the output node of the voltage generator is fixed, and wherein the first output voltage decrease when the temperature is fixed and the current flowing from the output node of the voltage generator increases; and a current splitter, coupled to the output end of the voltage generator, for increasing the current flowing through the current splitter when the temperature rises, wherein the current splitter comprises a plurality of transistors coupled in serial each of the transistors comprises a gate, a first drain/source, a second drain/source, and a base; and the base is coupled to the first drain/source, and the gate is coupled to the second drain/source.

2. The voltage generating apparatus according to claim 1, wherein the current splitter is a voltage divider, and the current flowing through the voltage divider comprises a positive temperature coefficient (PTC).

3. The voltage generating apparatus according to claim 1, wherein the transistors are connected in series and work on sub-threshold region.

4. The voltage generating apparatus according to claim 1, wherein the voltage generator comprises:

a current source, for generating a first current, a second current, and a third current according to a control voltage, wherein a ratio between the first current, the second current, and the third current is 1:1:G, and G is a rational number;

a first voltage source, comprising a first end and a second end, wherein the first node is coupled to the current source, and the second end is coupled to a ground voltage; the first voltage source generates a first differential voltage between the first node and the second node according to the first current; and the first differential voltage comprises a first negative temperature coefficient (NTC);

a second voltage source, comprising a first end and a second end, wherein the first end is coupled to the current source; the second voltage source generates a second differential voltage between the first end and the second end according to the second current; the second differential voltage comprises a second NTC, and the first NTC is larger than the second NTC;

an operational amplifier, comprising a first input node, a second input node, and an output node, wherein the first input node is coupled to the first node of the first voltage source, the second input node is coupled to the first node of the second voltage source, and the output node outputs the control voltage;

a first transistor, comprising a gate, a first drain/source, and a second drain/source, wherein the second drain/source is coupled to the ground voltage, and the first drain/source is coupled to the second end of the second voltage source; and a second transistor, comprising a gate, a first drain/source, and a second drain/source, wherein the second drain/source is coupled to the ground voltage; and the first drain/source, the gate, the gate of the first transistor, the place where the current source outputs the third current, and the output node of the voltage generator are all coupled together.

5. The voltage generating apparatus according to claim 4, wherein the current source comprises:

a third transistor, comprising a gate, a first drain/source, and a second drain/source, wherein the first drain/source is coupled to a system voltage, the gate receives the control voltage, and the second drain/source is used for transmitting the first current;

a fourth transistor, comprising a gate, a first drain/source, and a second drain/source, wherein the first drain/source is coupled to the system voltage, the gate is coupled to the gate of the first transistor, and the second drain/source is used for transmitting the second current; and a fifth transistor, comprising a gate, a first drain/source, and a second drain/source, wherein the first drain/source is coupled to the system voltage, the gate is coupled to the gate of the first transistor, and the second drain/source is used for transmitting the third current;

wherein a ratio between channel sizes of the third transistor, the fourth transistor, and the fifth transistor is 1:1:G.

6. The voltage generating apparatus according to claim 4, wherein the first voltage source and the second voltage source respectively comprise:

a sixth transistor, comprising a base, an emitter, and a collector, wherein the base and the collector are coupled to the first node of the first voltage source, and the emitter is coupled to the second node of the first voltage source; and a seventh transistor, comprising a base, an emitter, and a collector, wherein the base and the collector are coupled to the first node of the second voltage source, and the emitter is coupled to the second node of the second voltage source.

7. The voltage generating apparatus according to claim 4, wherein the first voltage source and the second voltage source respectively comprise:

an eighth transistor, comprising a base, a gate, a first drain/source, and a second drain/source, wherein the base and the first drain/source are coupled to the first node of the first voltage source, and the gate and the second drain/source are coupled to the second node of the first voltage source; and a ninth transistor, comprising a base, a gate, a first drain/source, and a second drain/source, wherein the base and the first drain/source are coupled to the first node of the second voltage source, and the gate and the second drain/source are coupled to the second node of the second voltage source.

8. The voltage generating apparatus according to claim 4, further comprising a start-up circuit including an input node and a feedback node, wherein the feedback node is coupled to the output node of the operational amplifier, and the input node is coupled to the output node of the voltage generator, for stabilizing the first output voltage at the moment the system voltage is started.

9. The voltage generating apparatus according to claim 8, wherein the start-up circuit comprises:

a tenth transistor, comprising a gate, a first drain/source, and a second drain/source, wherein the gate is coupled to the input end of the start-up circuit, and the first drain/source is coupled to the system voltage;

an eleventh transistor, comprising a gate, a first drain/source, and a second drain/source, wherein the gate is coupled to the input node of the start-up circuit, and the first drain/source is coupled to the second drain/source of the tenth transistor;

a twelfth transistor, comprising a gate, a first drain/source, and a second drain/source, wherein the gate is coupled to the input end of the start-up circuit, the first drain/source is coupled to the second drain/source of the eleventh transistor, and the second drain/source is coupled to the ground voltage; and a thirteenth transistor, comprising a gate, a first drain/source, and a second drain/source, wherein the gate is coupled to the second drain/source of the eleventh transistor, the second drain/source is coupled to the ground voltage, and the first drain/source is coupled to the feedback node of the start-up circuit.

* * * * *